United States Patent [19]

Kelly et al.

[11] Patent Number: 4,699,059

[45] Date of Patent: Oct. 13, 1987

[54] EXPLOSIVE SHOCK TUBE HAVING LATERAL INITIATION PROPERTIES

[75] Inventors: George G. Kelly, Hawkesbury; David J. Welburn, Brownsburg, both of Canada

[73] Assignee: CXA Ltd./CXA LTEE, Montreal, Canada

[21] Appl. No.: 918,262

[22] Filed: Oct. 14, 1986

Related U.S. Application Data

[63] Continuation-in-part of Ser. No. 809,347, Dec. 16, 1985, abandoned.

[30] Foreign Application Priority Data

| | | | |
|---|---|---|---|
| Jan. 3, 1986 | [CL] | Chile | 007/86 |
| Jan. 6, 1986 | [AU] | Australia | 52106/86 |
| Jan. 9, 1986 | [PE] | Peru | 98688 |
| Jan. 9, 1986 | [ZA] | South Africa | 116/86 |

[51] Int. Cl.[4] ..... C06C 5/00; C06C 5/04

[52] U.S. Cl. ..... 102/275.7; 102/275.8

[58] Field of Search ..... 102/275.1, 275.3, 275.4, 102/275.5, 275.8, 275.9, 200, 275.10, 275.12

[56] References Cited

U.S. PATENT DOCUMENTS

| | | | |
|---|---|---|---|
| 1,887,122 | 11/1932 | Duffy | 102/275.7 |
| 3,590,739 | 7/1971 | Persson | 102/275.5 |
| 3,712,222 | 1/1973 | Richardson et al. | 102/275.1 |
| 3,730,096 | 5/1973 | Prior | 102/275.8 |
| 4,328,753 | 5/1982 | Kristensen et al. | 102/275.5 |
| 4,493,261 | 1/1985 | Simon et al. | 102/275.8 X |

*Primary Examiner*—David H. Brown

*Attorney, Agent, or Firm*—Donald G. Ballantyne

[57] ABSTRACT

A modified explosive shock tube is provided which has a lateral energy output and hence may be used as a trunk line in a non-electric blasting network. The modified shock tube comprises a hollow, flexible plastic tube having a layer of energy-producing material on its inner surface and also having at intervals along its length, cuts or slits which penetrate the tube wall. The area of the slits has an overcovering of a waterproof material. When energized, the tube will burst at the area of the slits to release energy in a direction lateral to the tube axis.

3 Claims, 3 Drawing Figures

EXPLOSIVE SHOCK TUBE HAVING LATERAL INITIATION PROPERTIES

This is a continuation-in-part of application Ser. No. 809,347 filed Dec. 16, 1985 now abandoned.

The present invention relates to low energy explosive shock tubing of the NONEL (Reg. TM) type. In particular, the invention relates to an explosive shock tube which is capable of the lateral initiation of a second, attached length of shock tube.

Explosive shock tubing as disclosed in Canadian Pat. No. 878,056 granted Aug. 10, 1971 is now widely known and used in the blasting art. This shock tubing or detonating fuse consists of small diameter, for example, 3 millimeters outside diameter tubing of a pliable plastic, such as, polyvinyl chloride, polyethylene, SURLYN (Reg. TM) or the like having an inner diameter of about 1.3 millimeters. The inner walls of the tubing has adhered thereto a thin layer of powdered explosive or reactive material, such as PETN (pentaerythritol tetranitrate), HMX (cyclotetramethalenetetranitramine) or powdered metal mixtures with these. When initiated at one end by means of an appropriate device, such as a detonating cap, a percussion or impact wave is propagated within and along the tubing to activate a blasting cap attached at the remote end of the tubing. When initiated, substantially all of the percussion wave energy is confined within the tube and little or no damage to the tube wall occurs. Indeed, it has been stated that the absence of any lateral energy allows an initiated shock tube to be held in the hand without great risk of injury. Explosive shock tubing may be employed in most instances as a replacement for conventional detonating cord in non-electric blasting and has the advantage of low noise, safe handling and low cost.

While the characteristic of lack of sideways or lateral bursting of conventional shock tube is advantageous from a safety viewpoint, the absence of the characteristic of lateral energy output precludes the use of shock tubing as a trunk line in non-electric blasting networks. Shock tubing heretofore has been limited for use as branch lines which are initiated by attachment to conventional, solid-core detonating fuse trunk line. Such conventional detonating fuse or detonating cord has a strong lateral energy output which is capable of initiating any properly attached shock tube branch lines.

In the preparation of non-electric, multiple-change blasting networks, a conventional detonating cord trunk line is laid along the ground surface or blasting face surface with the attached shock tube branch lines passing into the boreholes to set off the cap/charge combinations within the borehole. A large noise factor is associated with such circuits from the detonation of the surface trunk line which noise is objectionable, particularly on construction projects in built-up areas. There is a need, therefore, for a substantially noiseless, cost-effective alternative to detonating cord trunk line.

SUMMARY OF THE INVENTION

A modified explosive shock tube is provided which is capable of lateral initiation of an attached length of a second shock tube, which modified shock tube may be employed as a substantially noiseless trunk line in a non-electric blasting network.

The modified shock tube of the invention comprises a hollow, elongated flexible tube, the inner surface of which has a thin layer of powdered, energy-producing material distributed thereon. The shock tube has, at periodic intervals along its length, areas which are capable of bursting to release energy laterally to the axis of the tube upon initiation of the energy-producing material within the tube. In particular, the invention comprises an explosive shock tube, the walls of which are perforated at intervals along its length by means of elongated cuts or slits, the cuts or slits being protected with a thin outer layer or covering of waterproofing material. When the shock tube is initiated, the area of the slits will open and energy from the deflegrating material within the tube will be delivered through the opened slits at right-angles to the tube axis. This lateral energy is used to initiate a second length of shock tube the end of which second tube is positioned in alignment with the slits.

A more detailed explanation of the invention is provided in the following description in conjunction with the accompanying drawings.

DETAILED DESCRIPTION OF THE PREFERRED EMBODIMENTS

Figure 1:
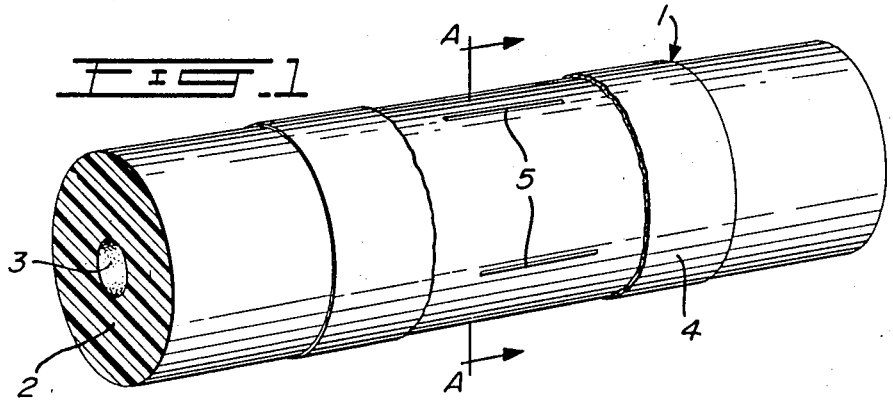
FIG. 1 is a perspective view of the shock tube of the invention showing the slit areas.
Figure 2:
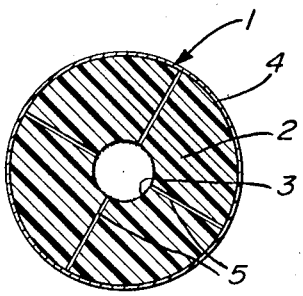
FIG. 2 is a cross-section of the shock tube of FIG. 1 taken along the line A—A.

Referring to FIGS. 1 and 2, there is shown a shock tube generally designated 1, which contains an inner core hollow tube of plastic material 2. The inner wall of tube 2 has adhered thereto a thin layer of powdered explosive or reactive material 3. A thin transparent overcovering material 4 is shown enveloping tube 2. Tube 2 contains a series of cuts or slits 5 which penetrate the tube walls.

Tube 1 is manufactured by first preparing a shock tube in a conventional manner, that is, plastic tubing 2 is extruded through a die with the simultaneous application of powdered explosive material to the inner wall thereof. The plastic of tubing 2 is preferably made from SURLYN, a salt-containing polyethylene ionomer, although any flexible plastic having good properties of adherence for the powdered explosive material can be used. The size of tube 2 is typically about 3 mm. outside diameter and 1.3 mm. inside diameter. After extrusion, tube 2 is passed lengthwise through a reciprocating cutter device where a series of slits 5 from about 0.5–1 cm. in length are made, preferably two to four in number, through the tube walls and spaced equally around the circumference of tube 2. Slits 5 may be made at any chosen linear interval along tube 2. After being slit, tube 2 is passed through a second circular die where a thin, external layer or coating of flexible waterproofing material 4 is bonded to the outer surface of tube 2. Alternatively, a spray coating of waterproofing material may be applied or a short length of adhesive tape, for example, vinyl tape can be applied over the area of the slits. A suitable waterproofing material 4 is, for example, a polyethylene/ethylvinyl acetate blend. To assist in locating the position of the slits 5 in the finished tube 1, the slit area of tube 2 may be coloured with an ink or dye prior to overcoating with a transparent waterproof layer 4.

Figure 3:
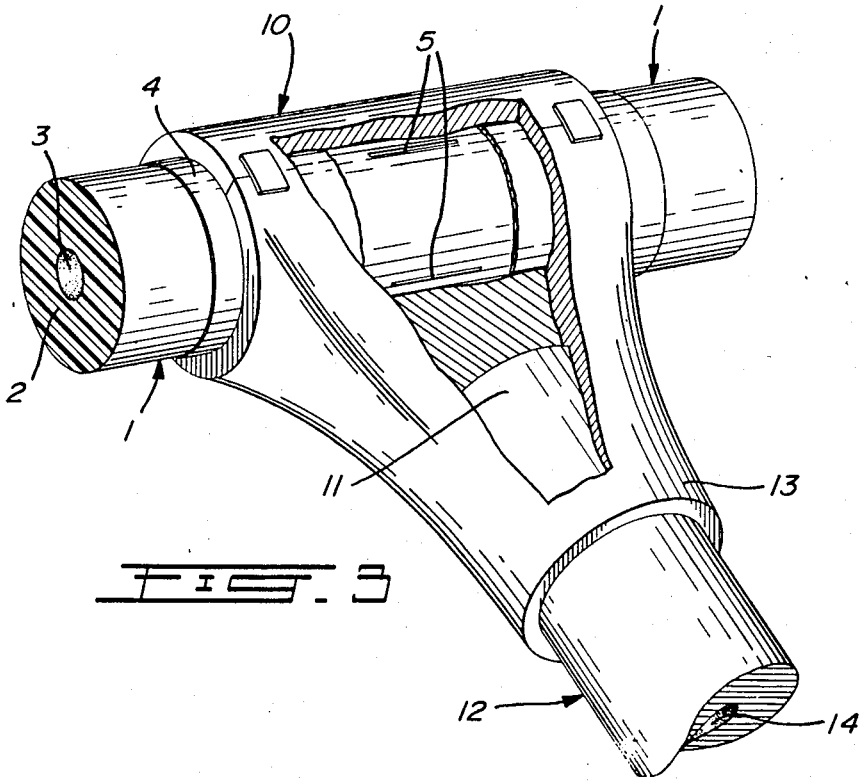
FIG. 3 shows a partly cut-away perspective view of a connection between the shock tube of the invention as a trunk line and a conventional shock tube as a branch line.

With reference to FIG. 3, there is shown a generally T-shaped connector device 10 mounted on or around trunk line shock tube 1. Connector 10 may comprise any configuration which permits the location of an end 11 of branch line shock tube 12 close to the slits 5 in trunk line 1. Connector 10, as shown, is typical of several known T-shaped connectors used in assembling blasting fuse circuits. In the depiction shown in FIG. 3, connector 10 which is hinged and sized to fit tightly around trunk line 1, is mounted so that its central area is adjacent to slits 5 in trunk line 1. Leg portion 13 of connector 10 is sized to receive in tightgripping relationship the end of a shock tube branch line 12 which is inserted into leg portion 13 until tube end 11 is close to or abutting slits 5. When trunk line 1 is initiated at a remote end (not shown), the energy pulse within tube 1 opens all the slit areas 5 and bursts the overcoating layer 4. The energetic material 14 within branch line 12 is initiated at locations where connectors are attached. A similar trunk-to-branch connection can be made at each slit location along trunk line 1, each branch line leading to a separate explosive charge in a blasting network.

EXAMPLE I

A NONEL shock tube containing 25 mg/m of a mixture comprising 8% powdered aluminium and 92% powdered HMX explosive was prepared for use as a trunk line in a 200 meter length. At one meter intervals along its length, two diametrically opposite slits 0.6 cm. in length were made in the shock tube trunk line. The location of each slit was indicated with an inked mark. The slit NONEL was overcoated by an extrusion process with a clear polyethylene/ethylvinyl acetate sleeve 0.2 mm. in thickness. Fifty standard NONEL receptor tube lengths were positioned adjacent the marked slits in the trunk line using the connector shown in FIG. 3 and the trunk line was initiated at one end by means of a NONEL-type initiator. All 50 receptor tube lengths were initiated without failure. In a similar test using un-slit NONEL having the same explosive content as the trunk line, no branch line initiation occurred.

EXAMPLE II

The test described in Example I was repeated at temperatures of −40° C. employing ten branch line connections. No failures occurred.

It has been observed that the material employed as the overcovering or waterproofing material 4 should be chosen so as to avoid fragmentation during initiation since small fragments of material could cause blockage of the end of the receptor or branch line tune and interfere with energy transfer between trunk line and branch line. It will be obvious to those skilled in the art, that the open end of the receptor branch line must be kept dry to ensure initiation. It will also be obvious that the amount of energetic material employed on the inner wall of tube 2 must be sufficient to provide energy adequate to open slits 5 and to rupture overcovering 4. The amount of energetic material used will depend on the length of slit 5, flexibility of the material of tube 2 and the thickness and resistance to rupture of the overcovering material 4.

We claim:

1. A modified low energy explosive shock tube having lateral directional energy output comprising a hollow elongated flexible tube, the inner surface of which has a thin layer of powdered energy-producing material distributed thereon, the said hollow tube having at periodic intervals along its length one or more slits which penetrate the said tube, the said slits being sealed by a thin, external, rupturable overcovering.

2. A shock tube as claimed in claim 1 wherein the thin overcovering comprises a polyethylene/ethylvinyl acetate sleeve.

3. A shock tube as claimed in claim 1 wherein the thin overcovering comprises an adhered vinyl film tape.

* * * * *